US005679209A

United States Patent [19]

Hinton et al.

[11] Patent Number: 5,679,209

[45] Date of Patent: Oct. 21, 1997

[54] LABELLING MACHINE

[75] Inventors: Gaylen R. Hinton, Merced; Stanley B. Black, Modesto, both of Calif.

[73] Assignee: CMS Gilbreth Packaging Systems, Inc., Trevose, Pa.

[21] Appl. No.: 634,438

[22] Filed: Apr. 18, 1996

Related U.S. Application Data

[63] Continuation of Ser. No. 308,243, Sep. 19, 1994, abandoned.

[51] Int. Cl.[6] ..... B65C 9/00

[52] U.S. Cl. ..... 156/566; 156/567; 156/448

[58] Field of Search ..... 156/566, 567, 156/568, 86, 570, 571, 448

[56] References Cited

U.S. PATENT DOCUMENTS

| | | | |
|---|---|---|---|
| 2,703,660 | 3/1955 | Von Hofe et al. . | |
| 2,868,160 | 1/1959 | Paulsen | 118/259 |
| 3,235,433 | 2/1966 | Cvacho et al. . | |
| 3,565,724 | 2/1971 | Yamaguchui et al. . | |
| 3,577,293 | 5/1971 | Ritterhoff . | |
| 3,604,584 | 9/1971 | Shank, Jr. . | |

(List continued on next page.)

FOREIGN PATENT DOCUMENTS

| | | |
|---|---|---|
| 1012906 | 6/1977 | Canada . |
| 0144198A3 | 6/1985 | European Pat. Off. . |
| 0219267A2 | 4/1987 | European Pat. Off. . |
| 2427987 | 6/1978 | France . |
| A7015187 | 4/1972 | Netherlands . |
| 1106653 | 3/1968 | United Kingdom . |
| 2029280 | 3/1980 | United Kingdom . |

*Primary Examiner*—James Engel

*Attorney, Agent, or Firm*—Morgan & Finnegan, L.L.P.

[57] ABSTRACT

A roll-fed labelling machine that can be quickly changed to process containers and labels of different sizes does not require changed cutters to match different label sizes by engaging at least 50% of each label on the vacuum drum before it is cut from the web. Infeed guides and roll-on-pad assemblies, specific to individual container sizes can be installed swiftly by means of fixed alignment pins. The starwheel, having a diameter that is only five times the diameter of the mid-size container that the labelling machine is designed to process reduces abrasion and vibration. Starwheels that are aligned and with preset timing adjustment integral with the starwheel members for each container size are changed quickly to synchronize starwheel timing with that of the labelling machine. A glue applicator has a heater cartridge in the glue bar for warming the glue to a suitable range, while the glue roller has a circumference of not more than nine inches to control thermal losses and to reduce glue "slinging" and glue "stringing."

4 Claims, 7 Drawing Sheets

U.S. PATENT DOCUMENTS 3,659,394 5/1972 Hartleib et al. .
3,693,567 9/1972 Dalman ..... 113/115
3,765,991 10/1973 Hoffmann .
3,834,963 9/1974 Hoffman .
3,878,960 4/1975 Jonsson et al. .
3,975,260 8/1976 Peyton et al. ..... 209/73
4,108,709 8/1978 Hoffmann .
4,108,710 8/1978 Hoffmann .
4,108,711 8/1978 Hoffmann .
4,124,433 11/1978 Herdzina et al. .
4,207,832 6/1980 Bowman et al. .
4,208,236 6/1980 Santefort .
4,216,044 8/1980 Herdzina et al. .
4,242,167 12/1980 Hoffmann .
4,323,416 4/1982 Malthouse et al. .
4,336,095 6/1982 Hoffmann .
4,347,095 8/1982 Yamashita .
4,366,016 12/1982 Golden, Jr. .
4,406,721 9/1983 Hoffmann .
4,416,714 11/1983 Hoffmann .
4,425,866 1/1984 Hoffmann .
4,443,285 4/1984 Roth et al. .
4,447,280 5/1984 Malthouse .
4,496,409 1/1985 Kontz .
4,500,386 2/1985 Hoffman .
4,519,868 5/1985 Hoffmann .
4,526,645 7/1985 Malthouse et al. .
4,544,431 10/1985 King .
4,545,832 10/1985 Hoffmann .
4,552,608 11/1985 Hoffmann et al. .
4,561,928 12/1985 Malthouse .
4,574,020 3/1986 Fosnaught .
4,604,154 8/1986 Fosnaught .
4,629,528 12/1986 Tanaka et al. .
4,632,721 12/1986 Hoffmann et al. .
4,662,925 5/1987 Thimons et al. .
4,671,836 6/1987 Fumei .
4,686,931 8/1987 Difrank .
4,693,210 9/1987 Difrank .
4,694,633 9/1987 Fujio et al. .
4,704,173 11/1987 Hoffman .
4,724,037 2/1988 Olsen ..... 156/578
4,726,872 2/1988 Olsen .
4,729,811 3/1988 Difrank .
4,735,668 4/1988 Hoffmann et al. ..... 156/568 X
4,761,200 8/1988 Szeremeta .
4,772,354 9/1988 Olsen et al. .
4,781,785 11/1988 Szeremeta .
4,832,774 5/1989 Difrank et al. .
4,844,760 7/1989 Dickey .
4,844,957 7/1989 Hoffman .
4,923,557 5/1990 Dickey .
4,931,122 6/1990 Mitchell .
4,977,002 12/1990 Hoffman .
4,984,413 1/1991 Cosmo .
5,037,499 8/1991 Bright et al. ..... 156/456
5,045,140 9/1991 Dickey ..... 118/259 X
5,078,826 1/1992 Rogall .
5,091,040 2/1992 Otruba .
5,091,239 2/1992 Przeworski et al. .
5,116,452 5/1992 Eder ..... 156/566

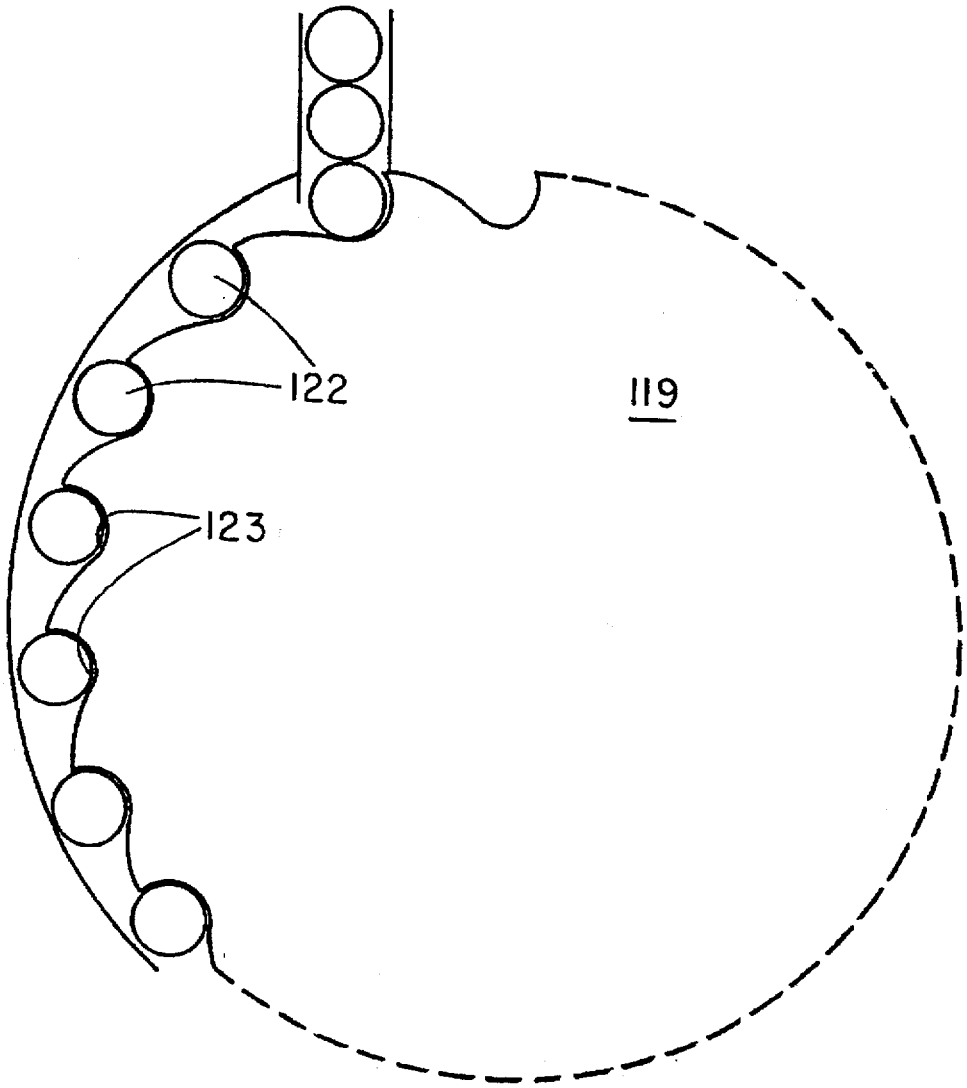
FIG. 9 (PRIOR ART)
FIG. 10
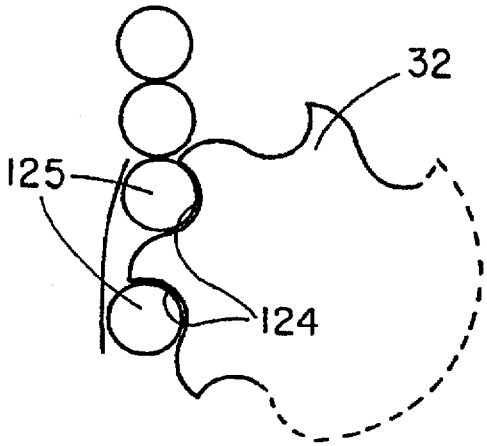

LABELLING MACHINE

This is a continuation of application Ser. No. 08/308,243, filed Sep. 19, 1994 now abandoned.

BRIEF SUMMARY OF THE INVENTION

1. Field of the Invention

This invention relates to labelling machines and, more particularly, to a roll-fed labelling machine that can be changed swiftly to process labels and containers of different sizes, and the like.

2. Background of the Invention

Machines for applying labels to containers are quite important, especially to satisfy the high production volume needed in the mass markets of a consumer oriented society. In this circumstance, there is a need to provide roll-fed labelling machines that glue labels neatly and in alignment with the containers to which they are applied. Also desirable, from the standpoint of production economy, is a roll-fed labelling machine that can be quickly adapted to process labels and containers of different sizes in successive production runs.

Applying glue to labels is a difficult production problem. Typically, glue is fed from a glue bar to a rotating glue roller that has a knurled surface. The glue is then transferred to appropriate label portions through a contact between the label and the glue roller. To maintain proper glue viscosity, it has been the usual practice to internally heat the rotating glue roller, a practice that creates awkward manufacturing and production problems.

The centrifugal force imparted by the rotating glue roller to the glue on the knurled surface, moreover, produces an undesirable "slinging" in which the glue that is not applied to the label is wastefully slung from the roller surface.

"Stringing" of the glue, which occurs when part of the glue adheres to the label, part to the glue roller and the rest of the glue stretching between the two also is quite undesirable for several reasons. Thus, it is preferable if some means can be found to eliminate this "stinging."

Labelling machines that can be adjusted to process labels and containers of different sizes are available. These machines, however, frequently require a skilled technician to spend from four to six hours to effect the adjustments that are needed to process label and container sizes that are different from the label and container sizes in the immediately preceding production run. Much more is lost, moreover, through this four to six hour delay in label machine change than just the cost of a skilled technician's time. For example, several hours spent in changing a roll-fed labelling machine to accept new label and container sizes may idle the entire production facility for the same length of time; interfere with the orderly packaging and shipment of the product; and cause the new, unlabelled product to back-up in the plant while awaiting the availability of a properly adjusted labelling machine.

Thus, for example, in prior art machines time was taken to change the label cutters to match the new label size. It had been learned that a small label cutter can not sever large labels from a web drawn from a label roll. Conversely, larger cutters interfered with control over the position of smaller labels relative to the containers to which they were to be glued. This latter situation frequently led to skewing the labels or placing the labels in the wrong position relative to the containers to which they were to be applied. A great deal of time also was spent in the tedious job of exactly positioning some of the labelling machine components (of which the infeed guide and the roll-on-pad were typical) to match a new container size.

To make these machine component adjustments, it usually was necessary to start the labelling apparatus after an initial adjustment, stop the machinery and make some more adjustments, then start the labelling machinery again and keep repeating this adjustment cycle until suitable approximations for the machine components were achieved.

One labelling machine component is the starwheel. This is a large, gear-like rotating member, that engages each container to be labelled in a respective cusp formed on the starwheel circumference in order to move the containers through the various stations in the labelling process. Changing, retiming and readjusting the starwheel to match new label and container sizes was, perhaps, one of the most time consuming tasks in labelling machine conversion. For example, the task of moving the starwheel axis through a distance that corresponded to the new container size and in timing the operation of the starwheel to synchronize starwheel movement with the rest of the labelling machine frequently took much of a skilled technician's time.

Ordinarily, prior art starwheels on roll-fed labelling machines were about 2' in diameter. The containers, received in the peripheral cusps of the starwheel, were thus moved swiftly through the labelling process because they were at the end of a relatively long starwheel radius, thereby not only being moved with great speed, but also being subject to centrifugal force. The containers were advanced into the cusps of these large starwheels generally in a direction that was in diametrical alignment with the respective starwheels. This structural arrangement forced the containers to undergo an abrupt increase both in speed and in changed direction as the containers were conveyed into the starwheel cusps in a radial direction, seized by the cusps and then moved at relatively high speed perpendicularly to the original path of container travel through a long arc of starwheel travel.

The abrupt container change in direction and speed that characterized prior art starwheels promoted a side-to-side container motion that caused an undesirable destructive vibration and abrasion.

What has been described above are the major adjustments that must be made to a prior art roll-fed labelling machine when the machine is to be adjusted to process containers and labels of new sizes. Other less time consuming adjustments, however, also must be made. These other adjustments, although not as burdensome as the starwheel adjustment described above, nevertheless do require considerable effort on the part of the technician who is effecting the conversion.

Thus, there is a need for a roll-fed labelling machine that can be more swiftly adapted to changes in label and container sizes, and that avoids the mispositioned labels, abrasions and vibrations that have characterized prior art devices.

BRIEF DESCRIPTION OF THE INVENTION

These and other inadequacies that have beset the prior art are overcome, to a great extent, through the practice of the invention. For example, in accordance with the invention, as the labels are drawn in a web from the roll to a rotating cutter drum that carries a cutter blade, a vacuum, drawn from the cutter drum interior causes the leading portion of the web to adhere temporarily to that vacuum drum's outer surface. The end of this web, however, is temporarily drawn, again under vacuum, against the surface of a rotating drum. It has been found, in accordance with the invention, that a vacuum drum will prevent label skewing and mispositioning, in spite of the cutter size if the vacuum drum fully controls the placement and temporary adhesion on the vacuum drum surface of the label at end of the web. To achieve this degree of vacuum drum control, temporary adhesion to the vacuum drum of about 50% of the area of the label to be cut is required at the time the label is severed from the web. Consequently, by establishing the cutting position sufficiently close to the vacuum drum to assure that about 50% or more of the label being severed from the web has temporarily adhered to the drum, an adequate control over label positioning is attained. Label sizes can then be changed as production needs dictate without imposing a requirement to change the label cutter if the contact between the label and the outer vacuum drum surface for the new label size is, at the time the label is severed, about 50% of the label area, or more.

As a result, by positioning the cutter sufficiently close to the vacuum drum to assure the desired vacuum drum surface contact with the label that is being severed from the web, the laborious task of changing cutters to match each new label size is, in large measure, overcome.

The difficulties that have characterized prior art efforts to heat the glue roller directly in order to maintain a suitable glue temperature are overcome by keeping the glue roller diameter small, thereby avoiding large surface area heat losses. The smaller diameter glue roller is also thermally isolated by means of low thermal conductivity spacers at opposite transverse cylinder ends.

Further in accordance with the invention, a heater cartridge is embedded in the metal body of the glue bar that applies this warmed glue to the glue roller. In this way, heat is effectively transferred to the rotating glue roller.

A heat sensing device, or thermocouple, is located on the glue bar and controls the glue temperature, thereby avoiding any need to secure electrical devices on or near the moving surface of the glue roller.

The centrifugal force applied to the glue by the smaller diameter glue roller of the invention is greater than that which characterizes the prior art because the smaller diameter glue roller must be rotated at a higher speed to reach the same surface speed as larger diameter prior art rollers. Contrary to the ordinary expectation that this increase in centrifugal force would aggravate the glue "slinging" problem, it has been found that the problem actually is relieved.

It appears, contrary to the direction taken by the prior art, that within the range of normal label adhesive viscosities, the glue roller makes one full revolution in less time than is required for parts of the glue pattern to draw together to form a drop large enough to be slung from the roller surface under centrifugal force. Thus, the glue bar applies glue to the rotating knurled surface of the glue roller. The roller then quickly sweeps through almost 360° while glue remaining on the roller is drawing up into a droplet. But, before a droplet can be formed, the glue is wiped from the surface of the roller by the glue bar.

The invention also avoids "stringing," to a large extent, through the use of a smaller diameter glue roller. The mechanism through which a small diameter glue roller so significantly reduces stringing is not entirely clear. Possibly, "stringing" with a smaller diameter glue roller may occur while the glue roller is still in contact with the very end of the label. If this happens, then it is possible that the strings are absorbed back on the label, on the glue roller, or on both label and roller.

Also, it is possible that the smaller diameter glue roller pulls away from the label surface faster than a larger diameter glue roller would move away from a label surface. The more abrupt movement of the glue roller from the label surface would seem to favor rupturing rather than stretching the adhesive.

In any event, whatever the actual mechanism might be, it has been found in accordance with the invention that smaller diameter glue rollers in which the glue temperature is maintained within acceptable limits through a heat source that is external to the glue roller not only avoids the technical difficulties of heating a rotating glue roller, but also overcomes in large measure the problems of glue "slinging" and glue "stringing."

An additional feature of the invention completely eliminates the tedious job of adjusting many of the other machine components. For instance, a generally arcuate infeed guide assembly guides the containers from the starwheel along a conveyor to the vacuum drum. The starwheel imparts a rotation to each of the containers that enables the labels that are applied to the containers at the vacuum drum to wrap completely around respective containers. After leaving the starwheel the rotating container and label combinations, moreover, are led from the vacuum drum down the conveyor by a roll-on-pad assembly.

Exact positioning of the roll-on-pad and infeed guide assemblies are among the more critical, time-consuming adjustments that characterized the prior art.

In accordance with the invention, however, the need for laborious tinkering to achieve an adequate roll-on-pad and infeed guide adjustment is avoided by providing sets of roll-on-pad and infeed guide assemblies that are adjusted each for one of the anticipated container sizes. Alignment pins on the labelling machine are seated in mating alignment bores on the pad and guide assemblies to establish the proper physical positions for these assemblies relative to the rest of the labelling machine. These assemblies are secured in place on the labelling machine by means of clamps. Thus, a great deal of otherwise forced idle production time and machine conversion labor is avoided by replacing these assemblies to match a new container size, rather than undertaking a time consuming readjustment of the pad and guide assemblies that are permanently fixed to the machine.

Speed and ease in adjustment is even further improved through the practice of the invention by means of a micro-adjustment device for the roll-on-pad assembly that permits small position changes to be made to the roll-on-pad while the labelling machine is in operation. This aspect of the invention avoids the prior art need to start the machine; note the approximate change that must be made; stop the machine; make the approximate adjustment; and restart the machine to observe if a still further adjustment is required.

The starwheel, in accordance with an additional characteristic of the invention, is mounted on a movable plate. This plate pivots about the axis of a bolt, which bolt also is axially coincident with the gear that drives the starwheel. In this manner, the entire starwheel assembly is pivoted about the bolt without changing the spacing between the driving gear and the driven starwheel shaft. As a consequence, there is no need to spend inordinate amounts of time and effort readjusting the drive mechanisms during the starwheel axis translations that are required during changeover to handle a different container size.

Starwheel timing, another source of label and container changeover delay, also is overcome through an alignment pin on the machine that permits a starwheel assembly, timed for a specific container size, to be clamped to the driven starwheel shaft. Through preset starwheel timing adjustments and the alignment pin, the timing that characterizes each of several selectively mountable starwheel assemblies now makes it possible to choose and install the starwheel assembly with the timing that is specific to a particular container size.

The invention also eliminates a great deal of the labelling machine vibration and the abrasions and side-to-side motions of the product that is being labelled. This improvement is achieved not only through the use of a considerably smaller starwheel than that which has been typical of the prior art, but also through the markedly reduced contact time between the containers that are being labelled and the starwheel that now is possible with the smaller diameter that characterizes the invention. Illustratively, it has been found in accordance with the invention that a starwheel assembly diameter that is no more than five times the diameter of the mid-sized container that the machine is capable of handling will produce markedly superior results. Thus, by using a much smaller starwheel, the length of container travel in starwheel contact as well as the speed and centrifugal force of container travel along the arc swept by the smaller diameter starwheel is significantly reduced. In this way, a starwheel according to the invention serves to separate the containers from each other and to bring them into contact with the roll-on-pad assembly and the vacuum drum. This occurs because the starwheel normally engages only one or two of the containers in the starwheel's rotational travel. Thus the containers are not forced to follow the arc of a starwheel for a significant period of time but are, instead, just separated from each other as they arrive at the starwheel from the conveyor, and brought into controlled contact with the roll-on-pad assembly and the vacuum drum. Consequently, undesirable container abrasion, side-to-side motion and labelling machine vibration is alleviated. This construction decreases changes in container speed and direction of container travel relative to those larger starwheel and container conveyor orientations that have characterized the prior art. This gentle transition for the containers, that is provided by the invention, as the containers proceed into and through the labelling apparatus eliminates a major source of vibration, abrasion and generally irregular operation. Further in this same respect, a smaller starwheel, in accordance with the invention, is provided at a lower cost and occupies less machine space.

Other labelling machine characteristics, of which the label scanner and flowgate position are typical, are in accordance with the invention, are provided with arbitrary scales and tables that relate these scales to different container and label sizes. During changeover to a new size it is only necessary to reset these components to match the preset indicia that is specified in the tables for particular container and label sizes in order to make the final adjustments that are required to adapt the labelling machine to these new label and container sizes. In this manner, much of the troublesome fine tuning for prior art machinery, which contributed to the four to six hour delay required to effect label and container size changes are no longer necessary.

Thus, there is provided through the invention an improved roll-fed labelling machine that is swiftly adapted to changes in label and container sizes. For a better appreciation of the invention, attention is invited to the following detailed description of a typical embodiment of the invention, taken with the figures of the drawing. The scope of the invention, however, is limited only through the claims appended hereto.

BRIEF DESCRIPTION OF THE DRAWING

FIG. 9 is a plan view of a prior art starwheel;

FIG. 10 is a plan view of a starwheel processing containers in accordance with principles of the invention;

DETAILED DESCRIPTION

Figure 1:
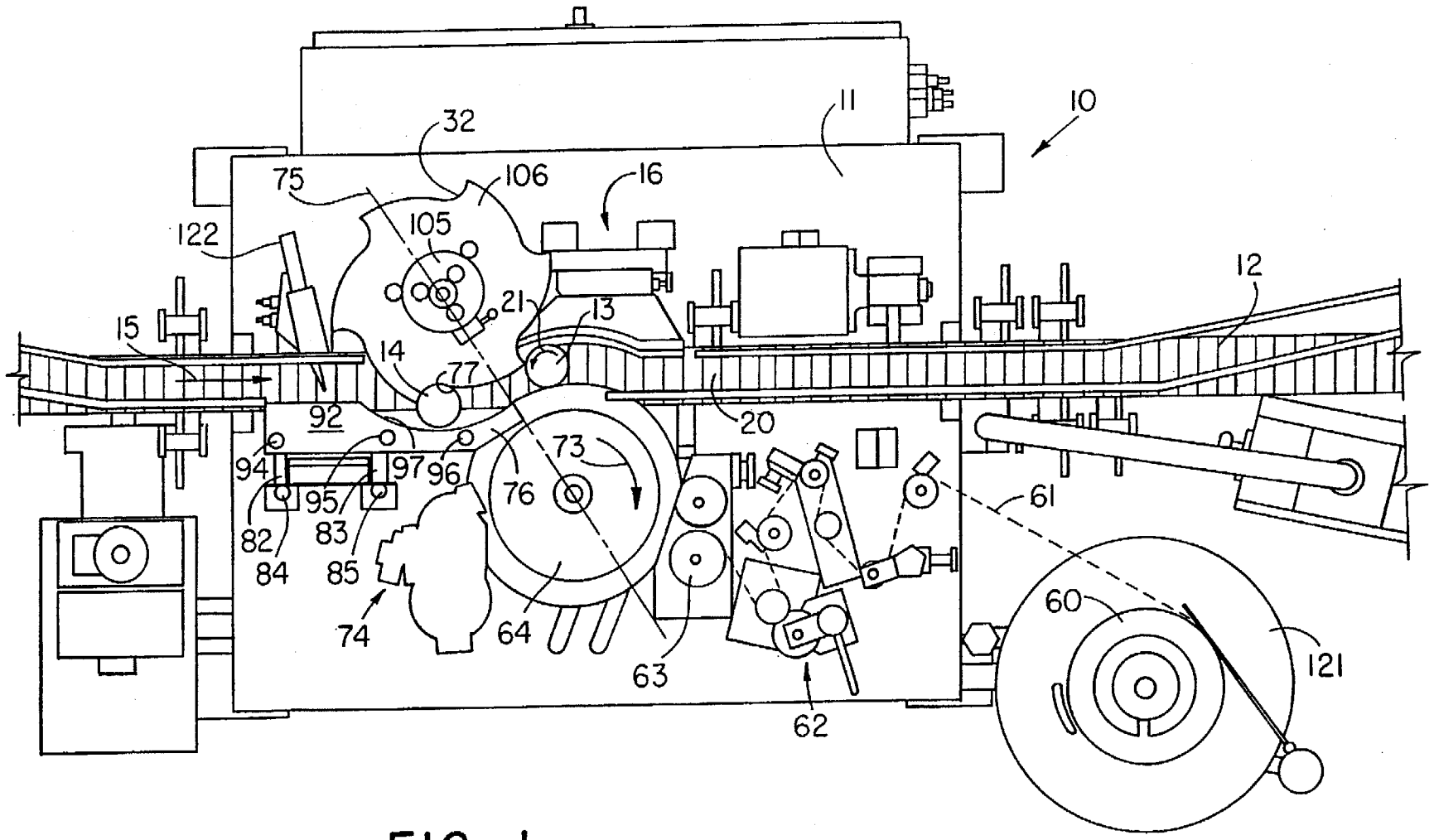
FIG. 1 is a plan view of a labelling machine that characterizes features of the invention.

For a greater understanding of the principles of the invention, attention is invited to FIG. 1 which shows a labelling machine 10 that is mounted on a mounting surface or generally flat table top 11. A link belt conveyor 12 moves containers or product packages 13, 14 toward the labelling machine 10 in the direction of arrow 15. The labelling machine 10 is designed to apply labels to containers that have a broad range of sizes, or diameters for cylindrical containers. Among this spectrum of container sizes that the labelling machine 10 can process is a mid-size container that is intermediate between the maximum and minimum container sizes the machine 10 will label.

Figure 4:
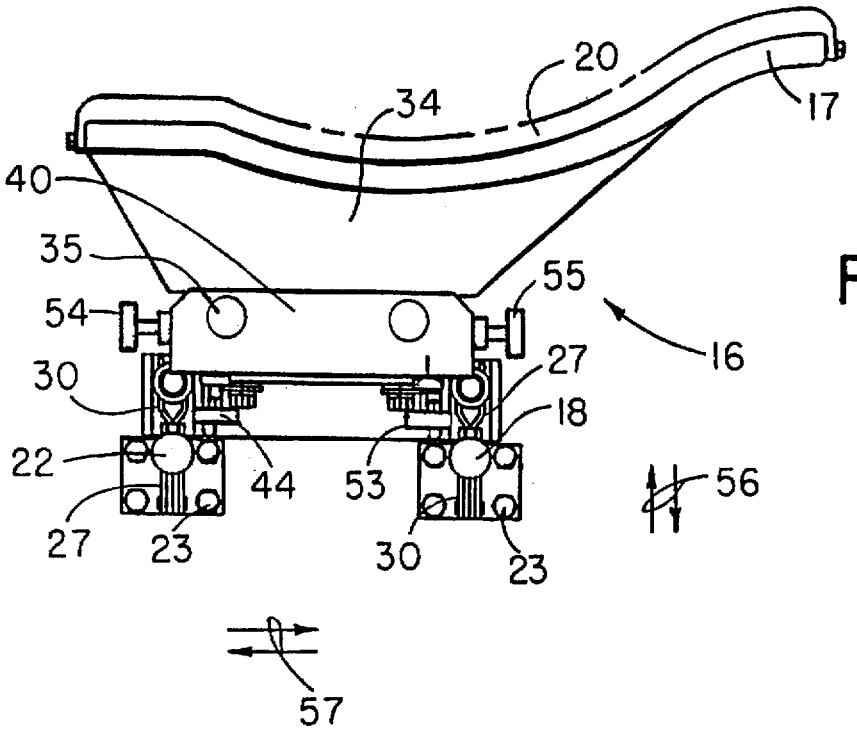
FIG. 4 is a detailed plan view of the roll-on-pad assembly that is illustrated in FIG. 1.

Containers on the conveyor 12 are first received in the labelling machine 10 by a starwheel assembly 32. The starwheel assembly 32, which will be described subsequently in more complete detail, moves the containers 13, 14 in the direction of the arrow 15 toward a roll-on-pad assembly 16. In cycling the containers 13, 14 through the labelling, the starwheel assembly 32 brings the containers past the roll-on-pad assembly 16, which imparts a counterclockwise rotation to these containers, in the direction of arrow 21. As best shown in FIG. 4, the roll-on-pad assembly 16 has a generally arcuate guide 17 that is covered with resilient padding 20. The padding 20 grips the containers and forces them to rotate in the desired direction.

Figure 5:
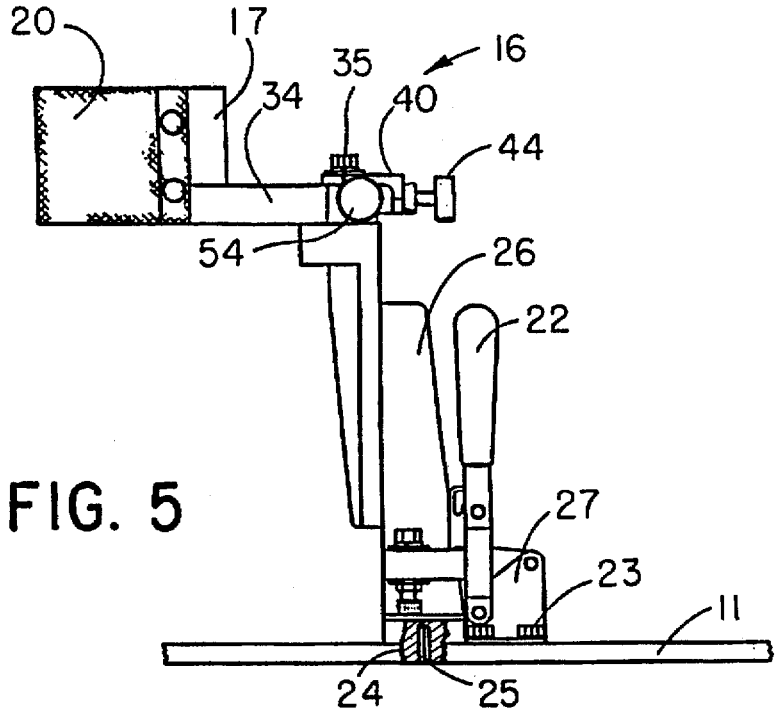
FIG. 5 is a side elevation showing a detailed view of the roll-on-pad assembly that is shown in FIG. 1.

Turning now to FIG. 5, the roll-on-pad assembly 16 is removably mounted on the table top 11 by means of manually operated toggles 18 and 22. The toggle 22 is, as shown in the drawing, is releasably coupled to a latch 27 that is fastened to the table top 11 with bolts 23.

In accordance with an important feature of the invention alignment pins, of which only alignment pin 24 is shown in FIG. 5, protrude from the table top 11. As shown, the alignment pin 24 is received in alignment pin recess 25 that is formed in a support 26 that is a part of the roll-on-pad assembly 16. A similar alignment pin recess is formed in a companion roll-on-pad assembly support that is not shown because it is out of the plane of the drawing and directly behind the support 26, as seen in FIG. 5.

When the roll-on-pad assembly 16 is placed on the table top 11 with the alignment pin 24 and the companion pin (not shown) fully seated in the respective recesses 25, the toggles 18 and 22 (FIG. 4) are engaged with respective latches 27, 30 to press and to releasably retain the roll-on-pad assembly 16 in its precise place on the table top 11. In this manner, the position of the padding 20 (FIG. 1) relative to the container 13 on the conveyor 12 is exactly oriented to produce an alignment with the rest of the labelling machinery that is specific to the container and label sizes that the machine 10 is processing.

Turning once more to the roll-on-pad assembly 16 that is shown in FIG. 5, the support 26 provides a mounting for the arcuate guide 17 and the guide padding 20. Thus, a base 34 that is generally parallel with the table top 11 is secured on one side, by means of bolts or the like, to the arcuate guide 17. On the opposite side, the base 34 is connected to the end of the support 26 that is opposite to the alignment pin recess 25 by means of a bolt 35.

Figure 6:
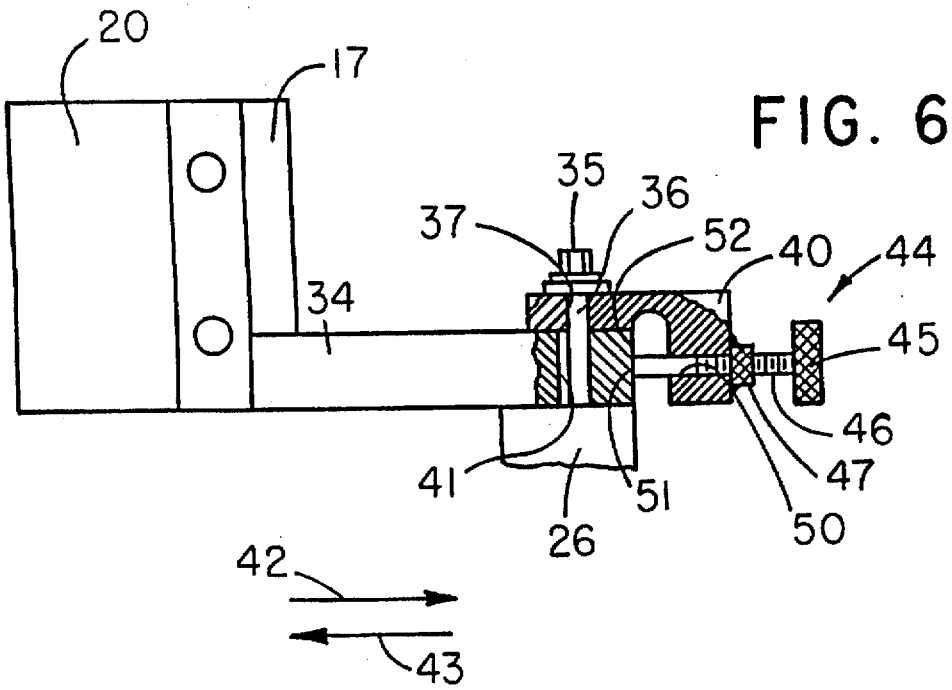
FIG. 6 is a detailed view, in broken section, of a typical roll-on-pad microadjustment device, as shown in FIG. 5.

For a better understanding of this feature of the invention, attention now is invited to FIG. 6, which shows a shank 36 for the bolt 35. The shank 36 is received in a bore 37 formed in a generally L-shaped bracket 40. Within the base 34 the shank 36 is received in a further bore 41, the diameter of the bore 41, however, is considerably greater than the diameter of the shank 36 to enable the base 34 to enjoy a limited degree of movement in the direction of arrows 42, 43, relative to the support 26, and in a plane that is parallel to the table top 11 (not shown in FIG. 6). Threaded portion of the shank 36 (not shown in the drawing) is engaged in a mating, tapped recess (also not shown in the drawing) in the support 26.

As illustrated, the base 34, the arcuate guide 17 and the padding 20 can move transversely relative to the support 26 in the directions of the arrows 42, 43 if the bolt 35 has been loosened. In accordance with the invention, fine adjustments are made with respect to the position of the guide 17 (FIG. 6) and the padding 20 through the manual micrometer adjustment 44. This micrometer adjustment 44 has a knurled knob 45 for manually controlling the movement of a threaded shank 46 that passes through a nut 47 that is welded to the bracket 40 in alignment with an unthreaded bore 50 formed in the base of the L-shaped bracket 40. In this manner, the threading on the nut 47 engages the threading on the shank 46 to enable a shank end 51 to protrude from the bore 50 and bear against an opposite side 52 of the base 34, the opposite side 52 being generally perpendicular to the plane of the table top 11 (not shown in FIG. 6).

To move the base 34 in the direction of either of the arrows 42, 43, it is only necessary to loosen the bolt 35 and turn the knurled knob 45 in the appropriate direction.

Best illustrated in FIG. 4, four micrometer adjustment structures 44, 53, 54 and 55 are provided in connection with the bracket 40 and the base 34 to enable fine positional adjustments to be made for the arcuate guide 17 and the padding 20. Illustratively, the micrometer adjustment structures 44 and 53 move the base 34 in the direction of arrows 56 and the micrometer adjustment structures 54 and 55 move the base 34 in the directions of arrows 57.

Returning to FIG. 1, a roll of labels 60 provide a web 61 of labels that is drawn through a feed roller system 62 to a cutter 63. In accordance with another characteristic of the invention, the cutter 63 is placed close to a cylindrical vacuum drum 64 that has a perforated surface. Physical relationships are, perhaps, best shown in FIG. 2 for the label web 61, the cutter 63 and the vacuum drum 64. Thus, the web 61 is drawn from the feed roller system 62 and is pressed against a perforated surface of a cylindrical cutter drum 65 because a vacuum is drawn within the cutter drum 65. The cutter drum 65, as shown, rotates in the direction of arrow 66. A cutter blade 67 protrudes from the cylindrical surface of the cutter drum 65 to press against the web 61. Vacuums, or lower air pressure, within the cutter drum 65 and the vacuum drum 64 are provided by means of a conventional low pressure air system that is not shown in the drawing.

In accordance with the invention, a stationary cutter blade 70 is placed as close as possible to the surface of the cylindrical vacuum drum 64. As the rotating blade 67 and the stationary blade 70 come into registry with each other, the portion of the web 61 that protrudes beyond the nip of these two blades is sheared from the web by the action of the blades 67 and 70. The label 71, which was sheared from the web 61 by the cutter blades 67 and 70, is temporarily pressed against perforated surface 72 of the vacuum drum 64 because of the vacuum that is drawn within the drum.

The spatial relation between the stationary knife blade 70, the blade 67 on the cutter drum 65 and the surface of the vacuum drum 64 is such that at the time the label 71 in the web 61 is sheared from that web, about 50% or more of the surface of the label is drawn against the perforated drum surface 72. It has been found, in accordance with invention, that the diameter of the cutting drum 65, heretofore critical with respect to the positioning, skewing or mispositioning of the label 71 on the vacuum drum 64, is of no significance if about 50% or more the label 71 is pressed against the perforated surface 72 of the vacuum drum 64 at the time the label is sheared from the web 61.

Further in this regard, it should be noted that the surface speed of the cutter drum 65 is slightly greater than the speed of the web 61. While, in turn, the surface speed of the vacuum drum 64 is somewhat greater than that of the cutter drum 65. The web 61 is, in this manner, constantly under tension throughout its length until the web is actually cut, causing the web, before cutting, to slip relative to both the cutter drum 65 and the vacuum drum 64. Because the majority of the label is on the vacuum drum before the cut is made, this enables the label 71 to stay in the same position on the vacuum drum 64 after the cut has been made regardless of operative speed. In this circumstance, even a small label can be cut with the vacuum drum 64 being in full control of the label at the time the label is sheared from the web 61 to assure proper positioning of the label on the drum 64.

Turning again to FIG. 1, the severed labels (not shown in FIG. 1) are rotated in the direction of arrow 73 on the vacuum drum 64 to a glue applicator 74. Glue is applied to the surface of the label that is exposed on the vacuum drum 64 by the glue applicator 74. The vacuum drum 64 rotates the leading edge of the glued label until the leading edge of the label is approximately in alignment with a line 75 between the rotational axis of the vacuum drum 64 and the starwheel assembly 32.

As illustrated in FIG. 1, the line 75 also coincides with the termination of an arcuate infeed guide 76. The container 14 in cusp 77 of the starwheel assembly 32 is pushed by the starwheel into engagement with the leading edge of the label and the label wraps itself around the container 14, which container continues its counter-clockwise rotation as indicated through the arrow 21.

The purpose of the infeed guide 76 is to serve, in combination with the starwheel assembly 32, to present the container 13 squarely to the vacuum drum 64 when the container 13 first contacts the label. The prior art, it will be recalled, required a tedious set of adjustments to the infeed guide position in order to adapt the infeed guide to a new container size.

Figure 3:
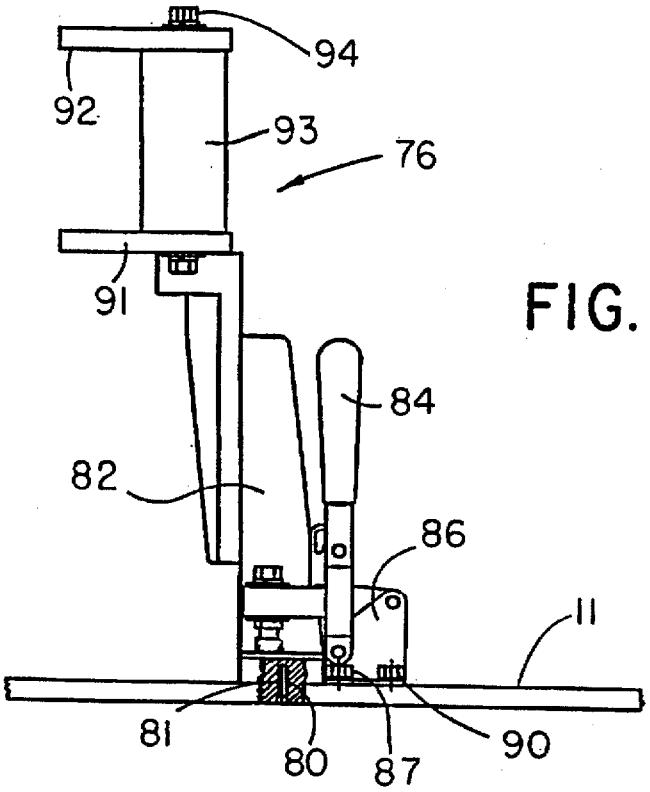
FIG. 3 is a side elevation showing a detailed view of the infeed guide assembly that is illustrated in FIG. 1.

In accordance with the invention, however, and as best shown in FIG. 3, the infeed guide 76 is one of a set of such guides, in which each or these guides is individually adjusted to match a specific container size. To assure correct alignment for each of the guides in the set, the infeed guide 76 is mounted on the table top 11 in a carefully aligned position established by means of infeed guide alignment pin 80 that protrudes perpendicularly from the table top 11. A second alignment pin (not shown in the drawing) also protrudes perpendicularly from the table top 11 in order to provide the precise alignment for the infeed guide 76 that characterizes this invention.

As shown, the one illustrative infeed guide pin 80 is received in an infeed guide alignment recess 81 formed in the base of an infeed guide support strut 82. As illustrated in FIG. 1, the infeed guide 76 has two support struts, the strut 82 and a strut 83. Note that it is in the base of the support strut 83 that the infeed guide alignment recess is formed to receive the alignment pin that is the companion to the pin 80, shown in FIG. 3. The struts 82 and 83 (FIG. 1), moreover, are releasably clamped to the table top 11 by means of toggles 84, 85.

Thus, in the manner described with respect to the roll-on-pad assembly 16, the illustrative toggle 84 associated with the infeed guide 76 that is shown in FIG. 3 selectively engages a latch 86. The latch 86, in turn, is secured to the table 11 by means of bolts, of which only the bolts 87 and 90 are shown in FIG. 3. The end of the strut 82 that is opposite to the alignment recess 80 is joined to infeed guide members 91, 92. These infeed guide members 91, 92 are separated from each other by means of an annular spacer 93 through which a bolt 94 is received in order to clamp together the guide members 91, 92. An array of three of the spacer 93 and bolt 94 combinations are fitted along the length of the pair of guide members 91, 92, of which, however, only the combination spacer 93 and bolt 94 are shown in FIG. 3. FIG. 1, nevertheless, does show heads for corresponding separation spacer bolts 95, 96 in the plan view projection of the apparatus.

The guide members 91, 92 (of which only the member 92 is shown in FIG. 1) each has an arcuate shape in a plane that is parallel to the table top 11. The parallel guide member 91, because it has precisely the same shape as the member 92 and is spaced immediately below the member 92 can not be seen in FIG. 1. As best illustrated in FIG. 1, the guide member 92 (as well as the companion member 91 that is not shown in FIG. 1) terminates, at the end of its arcuate shape in a plane that is essentially tangent to the adjacent circumferential portion of the vacuum drum 64.

In accordance with another feature of the invention, time and effort lavished on changing and readjusting starwheel axis translation and in timing the starwheel is avoided. Attention in this respect now is invited to FIG. 7 which shows the starwheel assembly 32 mounted on a movable plate 100. The movable plate bears against and is slidable relative to the table top 11, in a plane that is parallel to the table top.

Figure 7:
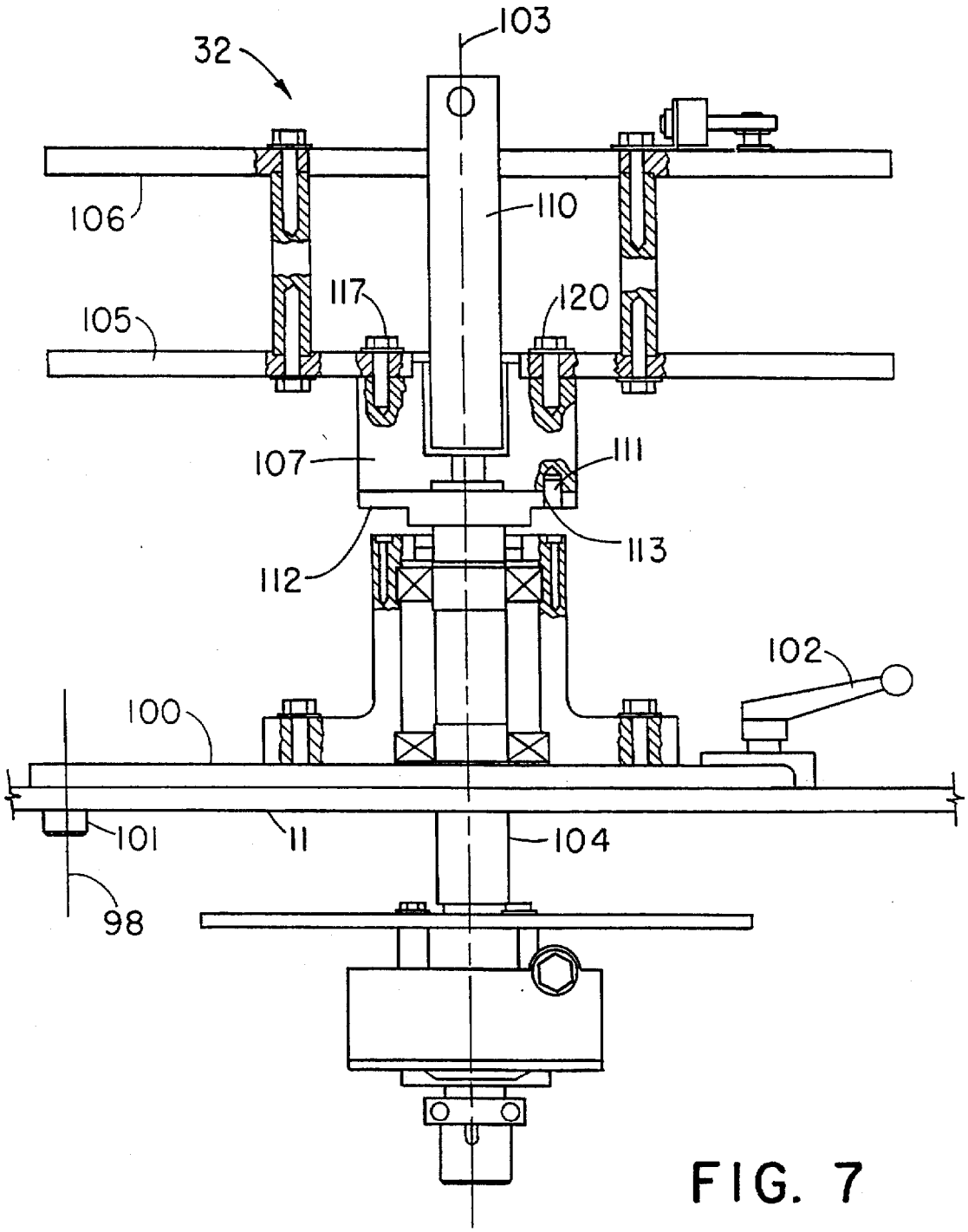
FIG. 7 is a front elevation in broken section of the starwheel assembly that is shown in FIG. 1.

A pivot means, or shoulder bolt 101, in accordance with the invention, is in axial alignment with the driving gear or sprocket (only axis 98 of which is shown in FIG. 7) for the starwheel assembly 32. The shoulder bolt 101, in keeping with a further feature of the invention, cooperates with a clamp 102 to releasably fix the position of the starwheel assembly 32 for a specific container size. Thus, the entire starwheel assembly 32 can be pivoted about the longitudinal axis of the shoulder bolt 101 without changing the horizontal separation between the driving gear axis 98 and axis 103 of the starwheel driven shaft 104. An arcuate slot (not shown in the drawing), is formed in the table top 11 with the axes of the driving gear and shoulder bolt as the slot's center to enable the driven shaft 104 to protrude through the table top 11 and to move with the adjustments that are made to properly position the starwheel assembly 32.

Consequently, to accommodate a new container size, the clamp 102 is released, the movable plate 100 with the starwheel assembly 32 is then shifted to a new position, appropriate to the new container size that is to be labelled and the clamp 102 is then reset.

For a more profound understanding of a particularly novel feature of the invention, attention now is invited to FIG. 9, which shows a large diameter prior art starwheel 119. Note particularly that the containers 122, when seated in starwheel cusps 123 extend around a longer portion of the circumference of the starwheel 119. This longer arcuate travel for the containers 122 and the abrupt change in container direction and speed as each container is sequentially received in a respective one of the starwheel cusps 123 promotes the vibration, abrasion and side-to-side movement that the present invention minimizes.

To avoid these undesirable attributes of the prior art, attention now is invited to FIG. 10 which shows the starwheel assembly 32 that characterizes the invention. As shown, the cusps 124 in the starwheel assembly typically engage not more than two containers 125 in order to minimize both the angular reorientation and speed of each of the containers 125 as they are moved by the starwheel assembly 32. Further in this same regard, the distance each of the containers 125 must travel along the circumference of the starwheel is, as shown in FIG. 10, significantly reduced. For any given container size, the smaller starwheel assembly 32 reduces both the angular displacement the container is subject to as it enters the starwheel and the distance it must travel in an arcuate path. It has been found that the benefits of this smaller starwheel are most apparent if the starwheel diameter is no more than five times larger than the mid-sized container that the labelling machine 10 is designed to label.

The need to synchronize, or retime the starwheel assembly 32 each time the container size is changed also is eliminated through the practice of the invention. As illustrated in FIG. 7, starwheel members 105, 106 are coupled together and are axially spaced from each other, the starwheel member 106 and a portion of the starwheel member 105 being shown in plan view in FIG. 1. Both of the starwheel members 105, 106 (FIG. 7), however, are mounted on a hub 107. The hub 107 supports both of the starwheel members 105, 106, for rotation in planes parallel to the table top 11. The hub 107 is mounted in the exact position appropriate to a specific container size by means of a draw bolt shaft 110 that clamps the hub 107 in position. The precise location, for timing purposes for the starwheel assembly 32, however, is established through alignment pin 111 that protrudes in an axial direction from a flange 112 that is secured to an end of the starwheel driven shaft 104. The alignment pin 111 is received in a mating recess 113 that is formed in the hub 107 to assure precise repositioning of the starwheel assembly 32 each time the assembly 32 that is shown in FIG. 7 is replaced in the labelling machine 10 (FIG. 1).

Figure 8:
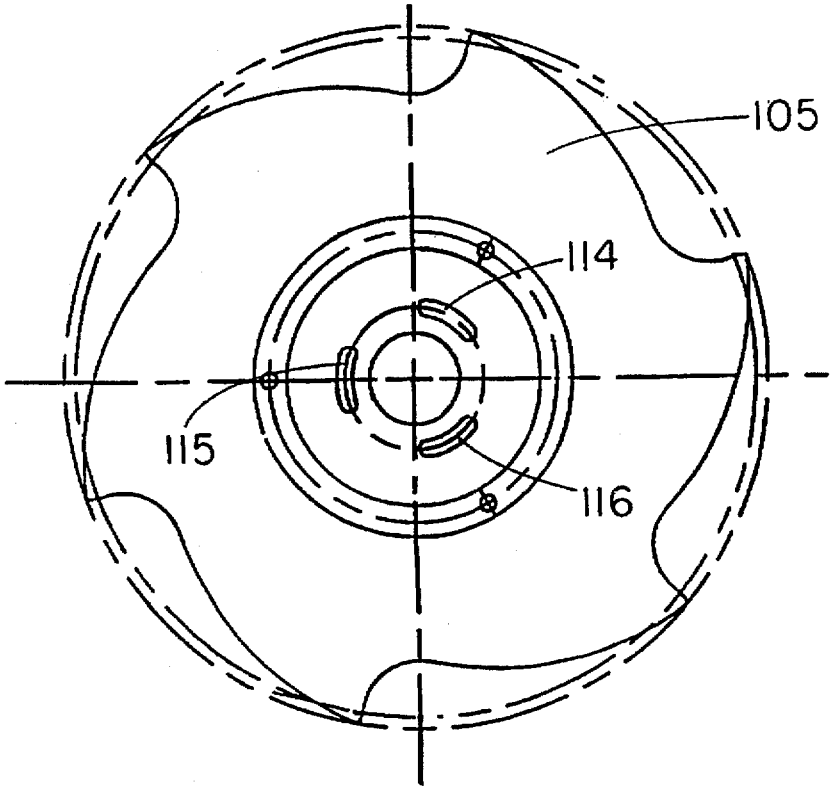
FIG. 8 is a plan view of a component for the starwheel assembly shown in FIG. 7 that embodies features of the invention.

Thus, to provide the starwheel timing required for a container of a size that is specific to the starwheel assembly 32 shown in FIG. 7, it is only necessary to select that assembly and install it on the driven shaft 104, the timing for the starwheel assembly having been accomplished earlier, through another feature of the invention. With respect to this present timing adjustment feature of the invention, the starwheel member 105, as shown in FIG. 8 is provided with three, arcuate and slotted holes 114, 115 and 116. These holes receive bolts of which only the bolts 117 and 120 are shown in FIG. 7. By releasing the bolts 117 and 120 (as well as the third companion bolt that is not shown in the drawing) the starwheel assembly 32 can be timed relative to the rest of the labelling machine 10 (FIG. 1). Rotating the starwheel assembly 32 through a suitable angle relative to the hub 107 to match the starwheel timing to that of the entire labelling machine, relative to the alignment recess 113 provides an alignment and an adjustment means that is integral with the coupled starwheel members 105, 106.

Upon properly timing the starwheel assembly 32 for a particular container size, the bolts 117 and 120 are tightened to effectively capture the specific timing for the starwheel assembly 32 by securing the starwheel member 105 to the hub 107 and thereby fixing the relation between the hub and the alignment pin 111. By establishing the timing, for each one of several starwheel assemblies that are individual to a respective container size, proper starwheel timing is immediately available for a range of container sizes by simply choosing, and then installing, the starwheel assembly that is appropriate to the next size of container to be labelled.

Figure 11:
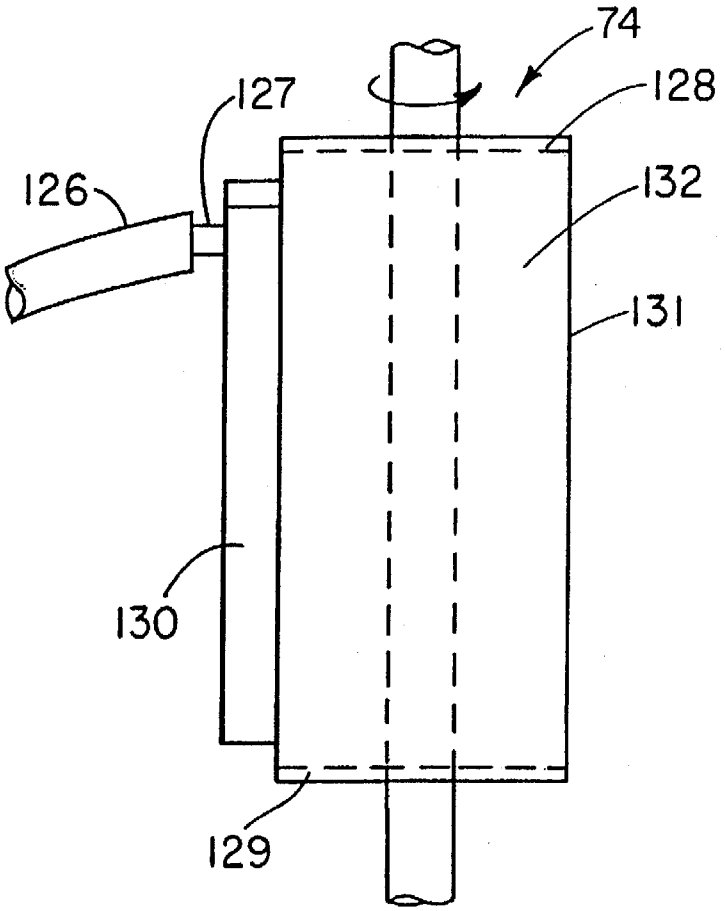
FIG. 11 is a front elevation schematic diagram of a glue bar and glue roller that characterizes the invention.

A further embodiment of the invention relates to the glue applicator 74, as shown in FIG. 1. For a more detailed appreciation of the improvements that characterize this feature of the invention, attention is invited to FIG. 11 which shows a portion of the glue applicator 74. As illustrated in FIG. 11, a labelling glue, under pressure, is pumped through a hose 126. The glue (not shown) flows through a nipple 127 to a glue bar 130, the glue bar preferably being formed of brass. A lengthwise recess (not shown) within the glue bar 130 applies a film of glue to a knurled surface 131 of a cylindrical glue roller 132. As described subsequently in more complete detail, the transverse ends of the glue roller 132 are closed by means of low thermal conductivity isolation rings 128, 129, of stainless steel or some other suitably poor conductor of heat. Further in this regard, the length of the glue roller 132 is significantly greater than the corresponding dimension of the glue bar 130. In this way, the ends of the glue roller 132 extend beyond both ends of the wetted surface of the roller that is established by the glue bar 130.

In accordance with the invention, it has been learned that a cylindrical glue roller having a circumference of not more than nine inches, which is smaller than prior art glue rollers, overcomes to a significant degree the glue "slinging" and glue "stringing" that have beset prior art glue rollers.

Figure 12:
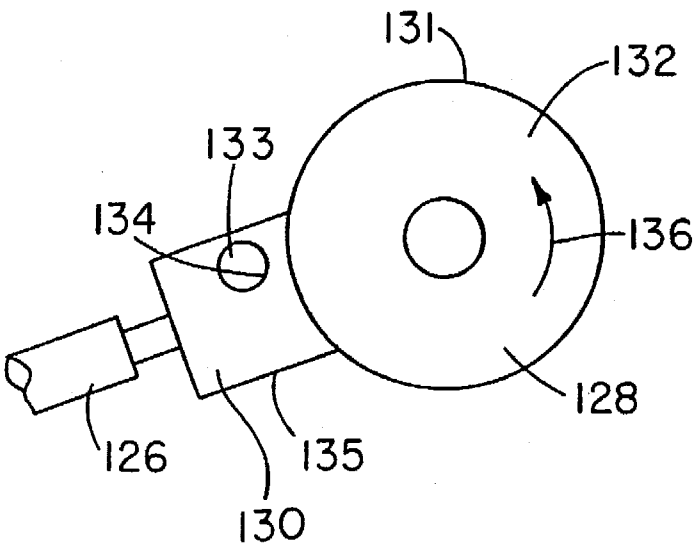
FIG. 12 is a plan view of the schematic glue bar and glue roller shown in FIG. 11.

Attention is now invited to FIG. 12 which shows, in plan view the glue roller 132 and the glue bar 130 that applies the film of glue to the knurled surface 131 of the glue roller 132. To maintain proper glue viscosity, it is necessary to maintain the temperature of the glue within an acceptable range. Toward this end, an additional aspect of the invention provides a heater cartridge 133 that is received in a lengthwise well 134 formed in the glue bar 130. The heater cartridge therefore transfers its heat directly to the metal body of the glue bar, and through the wetting action of the adhesive, transfers that heat to the glue roller. A temperature sensing device, or thermocouple 135 is secured to the outer surface of the glue bar 130 in order to register the temperature of the glue bar 130 and the glue within in order to keep the glue temperature within a prescribed temperature range.

Thus, the structural combination of the glue bar 130 and the small diameter glue roller combine to produce a number of important improvements. For example, the small diameter of the glue roller 132 not only overcomes a great deal of the glue "slinging" and "stringing" that accompanied prior art devices, but it also reduces the area of the exposed knurled surface 131 on the glue roller 132, thereby further reducing a source of heat loss from the film of glue that is to be applied to the label.

To provide a further barrier to heat loss from the glue roller 132, the poor thermal conductivity of the stainless steel isolation rings 128, 129 in the transverse ends of the glue roller 132 make a significant contribution.

In operation, to adapt the labelling machine 10 (FIG. 1) to apply a size of label to a container that is different from the label and container sizes in a production run just completed, the labelling machine 10 is deenergized. A roll 60 of new size labels is mounted on a spool 121 and the label web 61 that is drawn from the roll 60 is threaded through the feed roller system 62.

Figure 2:
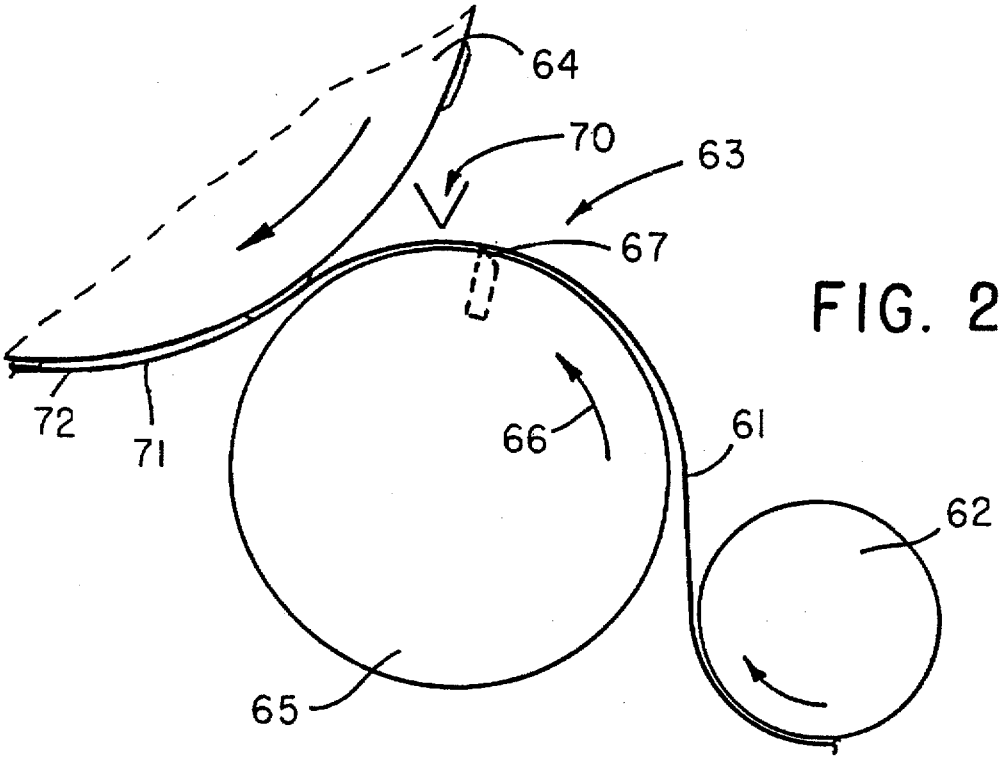
FIG. 2 is a schematic drawing of a portion of the apparatus shown in FIG. 1.

As best illustrated in FIG. 2, the web 61 is passed over the cutter drum 65 and the bitter end of the web 61 is placed against the vacuum drum 64. In accordance with the invention, about 50% or more the flat surface of the leading label in the web 61 is placed against the vacuum drum and vacuums are drawn in both the vacuum drum 64 and the cutter drum 65. By placing about 50% or more of the label in the web 61 on the vacuum drum 64, there is no need to change the cutter drum 65 (or the entire cutter assembly) to match the label size in order to assure correct positioning and alignment of the label on the vacuum drum 64. In this way, the burdensome task of replacing the cutter each time the label size is changed is completely eliminated.

Returning once more to FIG. 1, it is clear that to adapt the labelling machine 10 to a new container size, the roll-on-pad assembly 16 must be changed. The usual expenditure of time and human effort in tinkering with small adjustments to provide the necessary clearance for the roll-on-pad assembly are eliminated through a further application of the invention.

Turning now to FIG. 4, by manipulating the toggles 18, 22 to unlatch and release the roll-on-pad assembly 16 from latches 27, 30 on the table top 11, the complete assembly 16 for the preceding run of containers is lifted directly off the alignment pin 24 in FIG. 5 (and the associated pin, not shown in the drawing). A differently adjusted roll-on-pad assembly 16, that is adapted to the size of container that is next to be labelled is installed on the alignment pin 24 and the other alignment pin, not illustrated.

The toggles 18, 22 are engaged with their respective latches 27, 30 and the new roll-on-pad assembly 16 is mounted in place, correct for the forthcoming container size, subject to some micrometer adjustment.

In a similar manner, and as shown in FIG. 1, the infeed guide 76 for the preceding labelling production run is removed from the labelling machine 10 by manipulating the toggles 84, 85 to unlatch them. For example, FIG. 3 shows the toggle 84 releasably connected to the latch 86. When unlatched, the infeed guide 76 is lifted off the alignment pin 80, as well as being lifted off the companion alignment pin that is not shown in the drawing. The infeed guide 76 that is appropriate to the new size container that is to be labelled, then is carefully mounted on the infeed guide alignment pins and the toggles 84, 85 both are manipulated to engage respective latches on the table top 11 and thus firmly secure the new infeed guide 76 in place in the labelling machine 10. No adjustments are required. The proper infeed guide clearances needed to process the new size containers are established without a further expenditure of time and effort.

In a similar manner, the starwheel assembly 32 (FIG. 7) for the preceding production run is first removed by releasing the draw bolt shaft 110 from the starwheel assembly, thereby enabling the starwheel assembly with its associated hub 107 to be withdrawn from the driven shaft 104. The clamp 102 is released and the shoulder bolt 101 allows the movable plate 100 to be shifted to an angular relation for the starwheel assembly 32 that is appropriate to the new container size. When this relation is established, the clamp 102 is tightened to releasably secure the starwheel driven shaft 104 in its proper location for the new container size. In this way, much of the effort that characterized the tedious starwheel position adjustments and readjustments of the prior art is eliminated.

The starwheel assembly 32 that is appropriately timed for the new container size is mounted on the driven shaft 104 with the recess 113 in the hub 107 aligned with and seated on the alignment pin 111. The draw bolt shaft 110 then joins the starwheel assembly 32 to the driven shaft 104 without any need to undertake a retiming adjustment. In this manner, both alignment and preset adjustment that matches starwheel member timing to the timing for the labelling machine is integral with the coupled starwheel members 105, 106.

The entire labelling machine 10 (FIG. 1) now is energized to impart a rotation to the containers and to move these containers through the labelling machine 10 by advancing the containers into the cusps in the starwheel assembly 32. In this way, the containers are forced down the conveyor 12 in the direction of the arrow 15, through the infeed guide 76 and past the roll-on-pad assembly 16. Some further adjustment nevertheless may be needed, for example, as wear occurs. For this purpose, the roll-on-pad micrometer adjustment structures 44, 53, 54 and 55, best illustrated in FIG. 4, are to be employed. Thus, as shown in FIG. 6, while the labelling machine is running, the bolt 35 is loosened to enable the knurled knob 45 to be turned to move the base 34, the arcuate guide 17 and the padding 20 in the direction of arrows 42 or 43, as appropriate, to establish the proper clearance past the roll-on-pad assembly 16 for the containers while the labelling machine is in operation.

In this way, final, small adjustments can be made to the position of the roll-on-pad assembly 16 (FIG. 1) while the machine is running. These fine scale adjustments, made during labelling machine operation, avoid the need in the prior art to keep stopping, adjusting, starting, stopping, readjusting and restarting the labelling machine to introduce these small, but necessary adjustments.

Other accessories on the labelling machine 10, of which flowgate 122 is typical, are provided with indicia that correspond to a table (not shown) enumerating the indicia that are characteristic of the various container sizes suitable for labelling by means of the machine 10. By matching the indicia on the machine accessories to that shown in the table for the predetermined container and label size that is next to be run on the machine 10, a further and valuable saving in conversion time is provided.

When fully assembled for operation with the new container and label sizes, a machine that operates much more smoothly and largely without vibration is now available.

Turning now to the portion of the glue applicator 74 that is shown in FIG. 12, the glue in the hose 126 is pressurized to flow into the glue bar 130. In accordance with the invention, the heater cartridge 133 that is embedded in the well 134 is energized to warm the glue to a temperature that is within the desired range as measured through the thermocouple 135. The small diameter glue roller 132 is driven in the direction of arrow 136. In this respect, it is important that the rotational speed of the glue roller 132 is greater than that of the larger rollers that have characterized in the prior art. Thus, the rotational speed of the knurled surface 131 on the roller 132 should be equal to the surface speed of larger diameter, prior art rollers in order to permit the smaller diameter roller 132 to keep pace with the labels 71 (FIG. 2) on the vacuum drum 64.

This smaller diameter of the glue roller 132, in spite of the higher speed, as mentioned above, also seems to contribute in some way to the reduction in glue "slinging" and in glue "stringing".

Thus, there is provided, through the practice of the invention, a labelling machine that significantly improves over prior art apparatus.

We claim:

1. A labeling machine for applying labels to containers on a conveyor, the containers on the conveyor being a size that is selected from a plurality of container sizes in which one of the sizes in the plurality is defined as a mid-sized container, comprising a starwheel assembly having a hub and a starwheel member and means connecting said starwheel member to the hub such that said starwheel member can be rotatively adjusted relative to the hub, said starwheel member including peripheral cusps formed in the circumference of the starwheel member, said circumference establishing a diameter for said starwheel member and each of said cusps for receiving one of the containers therein, a table for supporting said starwheel assembly, a slot positioned in the table, a starwheel drive shaft having a vertical axis and extending upward through said slot and engaging the starwheel assembly for driving the starwheel assembly, a driving gear for engaging said starwheel drive shaft and driving said starwheel assembly, an alignment plate that is movable relative to said table and supporting and aligning said starwheel assembly with respect to said conveyor, and including a pivot member mounted to said table and supporting said alignment plate so that said alignment plate will pivot about the pivot member relative to said table wherein said pivot member is in alignment with said driving gear axis, wherein said starwheel drive shaft moves through said slot as the alignment plate pivots about the pivot member, and wherein the horizontal separation between the axis of the starwheel drive shaft and the driving gear axis remains the same as the alignment plate is pivoted to accommodate new container sizes, a clamp mechanism mounted on the surface for locking the alignment plate with starwheel assembly thereon in a predetermined position and a flange that is secured to the end of the starwheel drive shaft, an alignment pin mounted on the flange, a recess formed in the hub for receiving the alignment pin to assure repositioning of a starwheel assembly each time a starwheel assembly is replaced, and wherein said starwheel member is rotated relative to the hub to match starwheel timing to the labeling machine.

2. A labelling machine in accordance with claim 1, wherein said starwheel assembly is no more than five times the diameter of the mid-sized container that the machine is capable of labelling.

3. A labeling machine for applying labels to containers on a conveyor, the containers on the conveyor being a size that is selected from a plurality of container sizes in which one of the sizes in the plurality is defined as a mid-sized container comprising a starwheel assembly having a hub, first and second starwheel members and means connecting said starwheel members to the hub such that said starwheel members can be rotatively adjusted relative to the hub, said starwheel members including peripheral cusps formed in the circumference of the starwheel member, said circumference establishing a diameter for said starwheel members and each of said cusps for receiving one of the containers therein, a table for supporting said starwheel assembly, a slot positioned in the table, a starwheel drive shaft having a vertical axis and extending upward through said slot and engaging the starwheel assembly for driving the starwheel assembly, a driving gear for engaging said starwheel drive shaft and driving said starwheel assembly, an alignment plate that is movable relative to said table and supporting and aligning said starwheel assembly with respect to said conveyor, and including a pivot member mounted to said table and supporting said alignment plate so that said alignment plate will pivot about the pivot member relative to said table wherein said pivot member is in alignment with said driving gear axis, wherein said starwheel drive shaft moves through said slot as the alignment plate pivots about the pivot member, and wherein the horizontal separation between the axis of the starwheel drive shaft and the driving gear axis remains the same as the alignment plate is pivoted to accommodate new container sizes, a clamp mechanism mounted on the surface for locking the alignment plate with the starwheel assembly thereon in a predetermined position, and a flange that is secured to the end of the starwheel drive shaft, an alignment pin mounted on the flange, a recess formed in the hub for receiving the alignment pin to assure repositioning of a starwheel assembly each time a starwheel assembly is replaced, and wherein said starwheel members are rotated relative to the hub to match starwheel timing to the labeling machine.

4. A labelling machine according to claim 3, wherein said second starwheel member has at least one slot formed therein for adjusting the angular relation between said first and second starwheel members and said alignment means to match said starwheel members timing to the labelling machine and to establish an alignment and adjustment means that is integral with said coupled starwheel members.

* * * * *